US005355990A

United States Patent [19]

Pitts et al.

[11] Patent Number: 5,355,990

[45] Date of Patent: Oct. 18, 1994

[54] BALUSTRADE HANDRAIL ENTRY SAFETY DEVICE

[75] Inventors: John T. Pitts, West Hartford; Ary O. Mello; Gerald E. Johnson, both of Farmington, all of Conn.

[73] Assignee: Otis Elevator Company, Farmington, Conn.

[21] Appl. No.: 159,066

[22] Filed: Nov. 29, 1993

[51] Int. Cl.[5] ..... B66B 29/04

[52] U.S. Cl. ..... 198/323; 198/338

[58] Field of Search ..... 198/323, 338

[56] References Cited

U.S. PATENT DOCUMENTS

| | | | |
|---|---|---|---|
| 2,708,997 | 5/1955 | Durang et al. | 198/338 |
| 2,846,045 | 8/1958 | Fowler | 198/323 |
| 3,809,206 | 5/1974 | Bredehorn et al. | 198/323 |
| 3,835,977 | 9/1974 | Hewitt et al. | 198/323 |
| 3,934,699 | 1/1976 | Saito et al. | 198/338 X |
| 3,970,187 | 7/1976 | Esaki et al. | 198/323 |
| 4,619,355 | 10/1986 | Adrian et al. | 198/323 |
| 4,924,995 | 5/1990 | Adrian et al. | 198/323 |
| 4,976,345 | 12/1990 | Adrian et al. | 198/323 |
| 5,064,047 | 11/1991 | Moldenhauer | 198/338 |

FOREIGN PATENT DOCUMENTS

| | | | |
|---|---|---|---|
| 1169629 | 5/1964 | Fed. Rep. of Germany | 198/338 |
| 2006542 | 8/1971 | Fed. Rep. of Germany | 198/323 |
| 52-61088 | 5/1977 | Japan | 198/323 |
| 53-34288 | 3/1978 | Japan | 198/323 |
| 0604787 | 4/1978 | U.S.S.R. | 198/323 |

*Primary Examiner*—D. Glenn Dayoan

[57] ABSTRACT

A handrail entry safety device including a collar and a base is provided for a balustrade having an enclosure and a handrail. The base includes an upper section and a lower section, the latter having a seat for receiving the collar. The upper section is hingedly attached to the lower section above where the handrail enters the safety device, thereby enabling the lower section and the collar to pivot together.

12 Claims, 4 Drawing Sheets fig.4
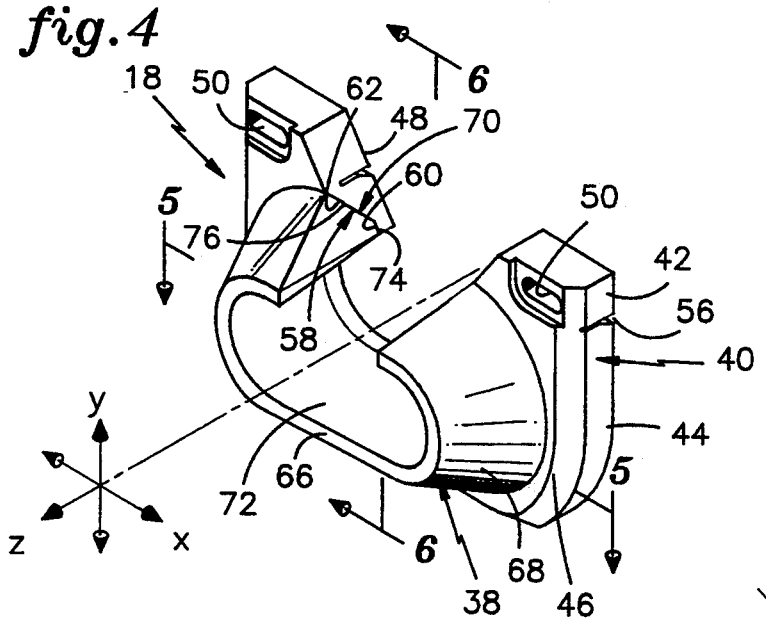
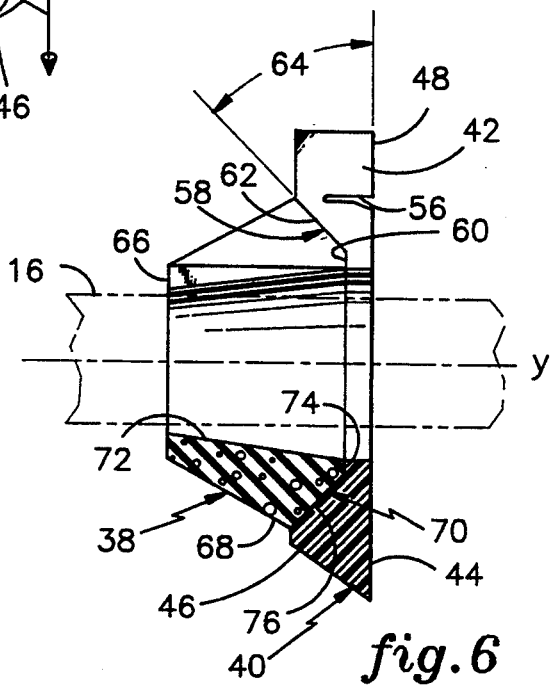
fig.6
fig.5
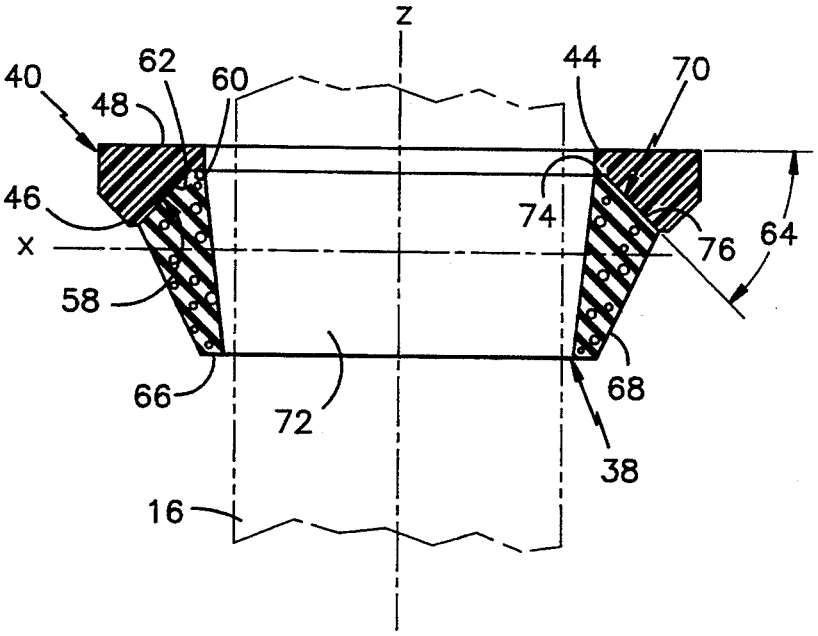

BALUSTRADE HANDRAIL ENTRY SAFETY DEVICE

BACKGROUND OF THE INVENTION

1. Technical Field

This invention relates to balustrades for people moving devices in general, and to balustrade handrail entry safety devices for people moving devices in particular.

2. Background Art

Escalators, moving walkways, and other people moving devices efficiently move a large volume of pedestrian traffic from one point to another. Passengers step on moving steps (or belts, treads, or pallets) and are transported along at a constant rate of speed. For safety reasons, a passenger handrail is provided on each side of the steps, traveling in the same direction and speed as the steps.

A balustrade, extending from the entry to the exit of the people moving device, supports and guides each handrail. Each balustrade includes a plurality of balustrade panels (typically glass) which rise up from an enclosure to support the handrail. Externally, the enclosure consists of a number of enclosure panels including an outer decking, an outer cladding, an inner profile, and a skirt panel. The outer decking and outer cladding enclose the mechanics on the side of the balustrade panel opposite the moving steps. The inner profile and skirt panel enclose the mechanics adjacent the moving steps.

The handrails are connected into endless loops which travel from one end of the device to the other along the top of the balustrade panels and then return through the enclosure. At each end of the balustrades, the balustrade panels have curved sections, or "newels", which enable the handrails to curve down and into the enclosure. The end of the balustrade where the handrail enters the enclosure and the end where it exits, depends on which direction the steps are traveling.

A person of skill in the art will recognize that the handrail entering the balustrade enclosure presents a potentially dangerous pinchpoint. Unwary hands, particularly small ones, can easily be drawn into the enclosure along with the moving handrail and thereby be injured.

Numerous attempts have been made in the prior art to prevent hands or other foreign objects from entering the enclosure, or to minimize the damage to those objects drawn in, or both. Some of the problems with the prior art solutions include marginal effectiveness and reliability. Hence, a person of skill in the art will recognize that a more effective and more reliable safety device is desirable.

DISCLOSURE OF THE INVENTION

It is therefore an object of the present invention to provide an effective balustrade handrail entry safety device.

It is a further object of the present invention to provide a reliable balustrade handrail entry safety device.

It is a still further object of the present invention to provide a device which actuates readily in response to a foreign object contacting the balustrade handrail entry safety device, before entrapment occurs.

It is a still further object of the present invention to provide a balustrade handrail entry safety device which can be easily manufactured and installed.

It is a still further object of the present invention to provide a device which can be retrofitted onto existing balustrades.

According to the present invention, a handrail entry safety device comprising a collar, a base, and an electrical switch is provided for a balustrade having an enclosure and a handrail. The base comprises an upper section and a lower section, the latter having a seat for receiving the collar. The upper section is hingedly attached to the lower section above there the handrail enters the safety device, thereby enabling the lower section and the collar to pivot together, and thereby activate the electrical switch.

According to one aspect of the present invention, a switch means is provided. An object contacting the lower section and/or the collar attached thereto, actuates the switch means.

According to a further aspect of the present invention, the collar comprises a channel having a cross-sectional area which increases as the channel extends from the exposed side of the collar to the side of the collar attached to the base.

According to a still further aspect of the present invention, the collar comprises an elastomeric material having a hardness which minimizes entrapment forces on an object should that object be drawn in between the collar and the moving handrail.

According to a still further aspect of the present invention, the seat for receiving the collar comprises a geometry which facilitates the deflection of the collar away from the moving handrail, thereby minimizing the entrapment forces.

According to a still further aspect of the present invention, the collar comprises a front edge perpendicular to the travel of the handrail which facilitates deflection of any foreign object striking the collar.

An advantage of the present invention is that the lower section of the base and the collar pivot together. Coupling the hingedly attached lower section and the collar enables both to be pivoted into contact with, and thereby actuate the electrical switch wired to stop the people moving device before an object becomes entrapped between the handrail and the collar.

A further advantage of the present invention, is the channel of the collar which tapers away from the handrail. The channel tapers away from the handrail as the channel extends toward the base and the balustrade enclosure, thereby increasing the cross-sectional area between the handrail and the collar. The increasing channel cross-section increases the space between the handrail and the channel walls and therefore minimizes the entrapment forces on any object which may become entrapped between the collar and the moving handrail.

A still further advantage of the present invention is the mating surfaces between the collar and the base. The seat forms an acute angle with the rear surface of the base. As a result, any lateral entrapment forces tend to push the collar material up the seat, away from the entrapped object, thereby minimizing the entrapment force on the object.

These and other objects, features and advantages of the present invention will become more apparent in light of the detailed description of the best mode embodiment, thereof, as illustrated in the accompanying drawings.

DETAILED DESCRIPTION OF THE DRAWINGS

FIG. 4 is a perspective view of the handrail entry safety device.

FIG. 5 is an X-axis cross-sectional view of the handrail entry safety device shown in FIG. 4.

FIG. 6 is an Y-axis cross-sectional view of the handrail entry safety device shown in FIG. 4.

BEST MODE FOR CARRYING OUT THE INVENTION

Figure 1:
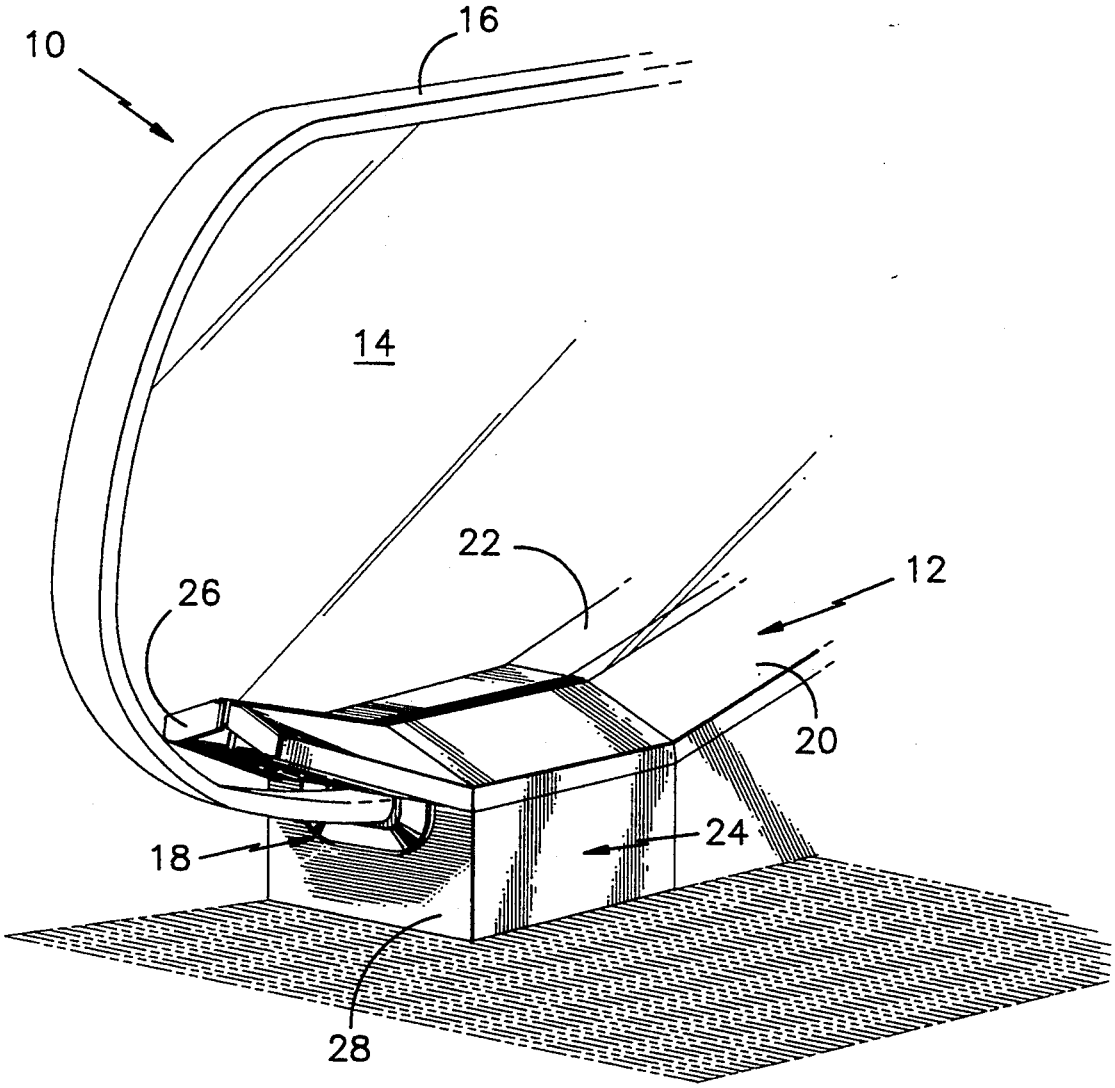
FIG. 1 is a perspective view of an escalator balustrade.
Figure 2:
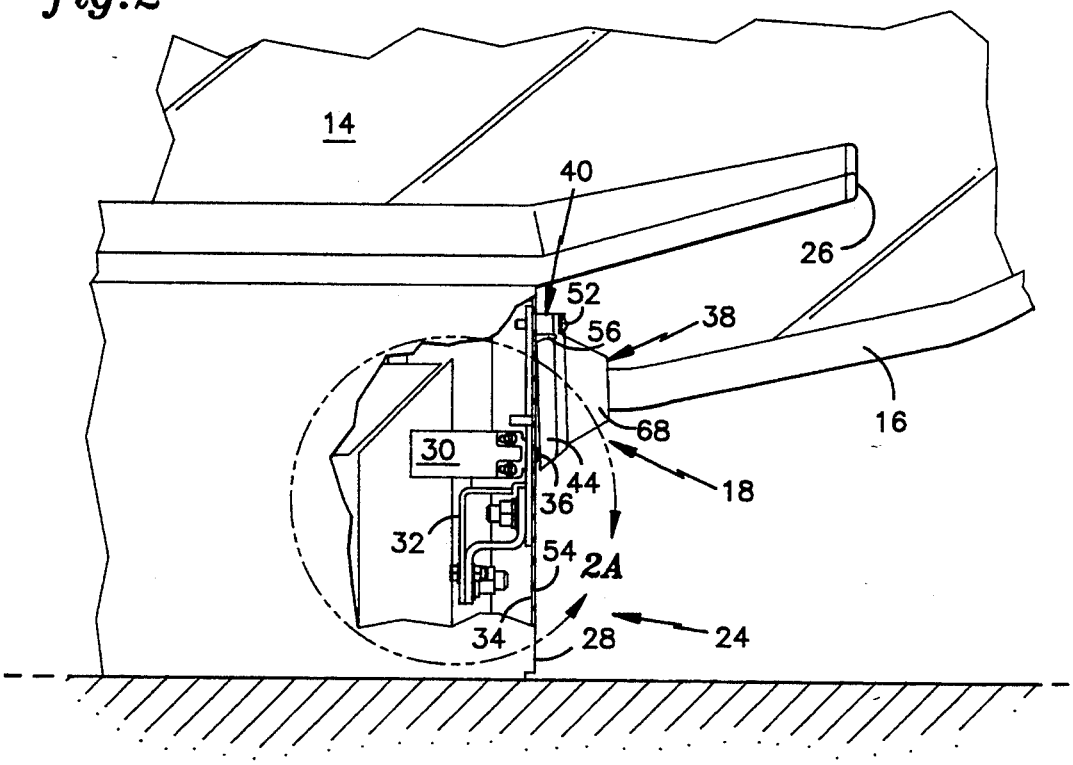
FIG. 2 is a diagrammatic sectional side view of the balustrade shown in FIG. 1.
Figure 2A:
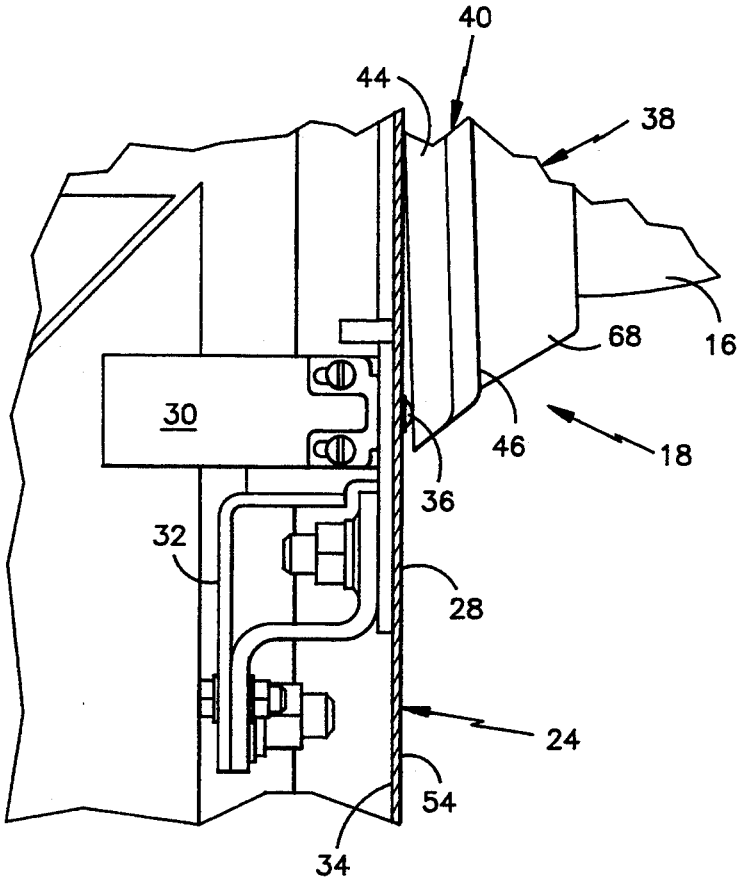
FIG. 2A is an enlarged view of the section noted in FIG. 2.

Referring to FIG. 1, an escalator 10 balustrade includes an enclosure 12, a balustrade panel 14, a handrail 16, and a handrail entry safety device 18. The enclosure 12 comprises an inner decking 20, an outer decking 22, and a handrail entry housing 24, the latter positioned at each end of the balustrade 10. The handrail entry housing 24 includes a shroud section 26 and an end panel 28. The handrail 16 passes underneath the shroud 26 and through an aperture in the end panel 28, while traveling into or out of the enclosure 12. Referring to FIGS. 2 and 2A, the handrail entry housing 24 further includes an electrical plunger type switch 30 mounted on a bracket 32 positioned adjacent the interior surface 34 of the end panel 28. The switch plunger 36 extends through the aperture in the end panel 28, outside of the housing 24.

Figure 3:
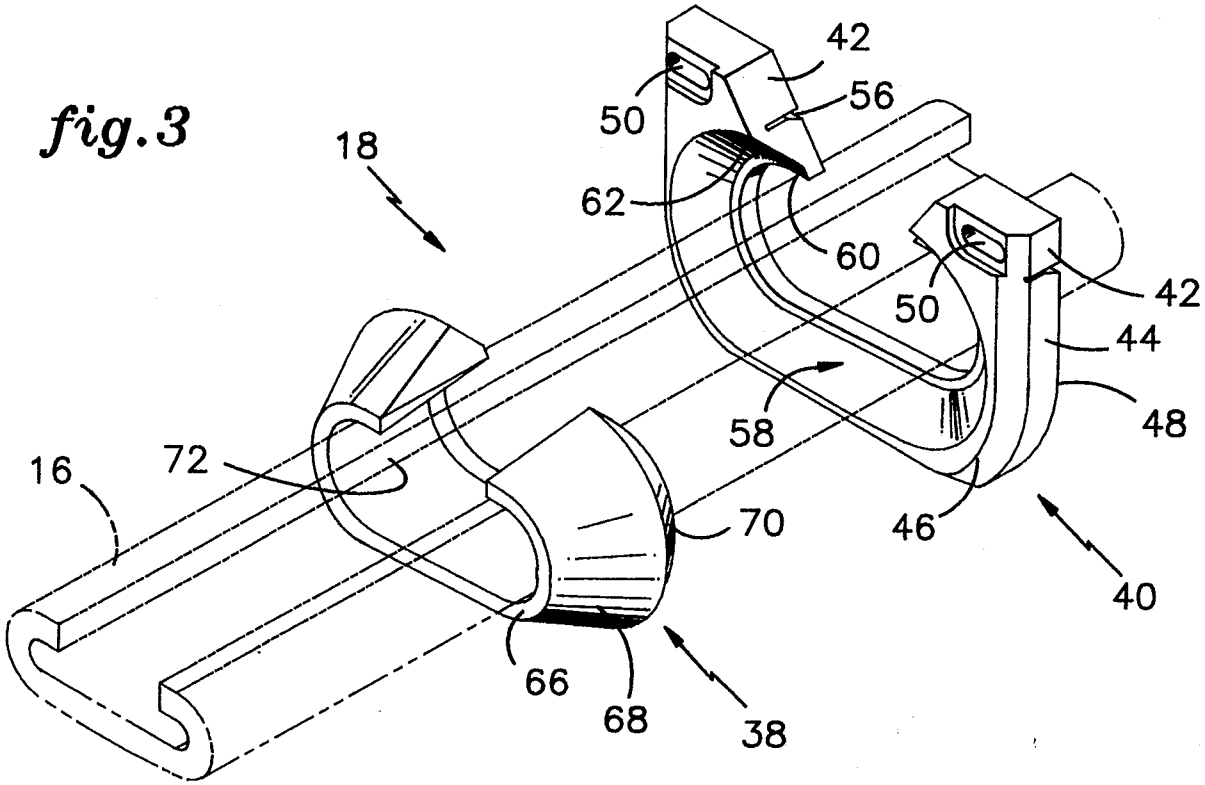
FIG. 3 is an exploded view of the handrail entry safety device.

Referring to FIG. 3, the handrail entry safety device 18 includes a collar 38 and a base 40. In the preferred embodiment, the collar 38 is attached to the base 40 by a commercial adhesive produced by the Loctite Corporation, entitled "Black Max 380". The base 40 comprises a thermo-plastic polyurethane or other semi-rigid material formed into an upper section 42 and a lower section 44, both having a front surface 46 and a rear surface 48. The thermo-plastic polyurethane has a hardness on the Shore scale of between 90A and 95A. The upper section 42 includes a pair of slots 50 extending through the front 46 and rear 48 surfaces for receiving conventional fasteners 52 (see FIG. 2). The conventional fasteners 52 (FIG. 2) attach the base 40 to the exterior surface 54 (FIG. 2) of the entry housing end panel 28. A notch 56 formed in the rear surface 48 of the base 40 between the upper 42 and lower 44 sections hingedly attaches the two sections 42,44. Specifically, the notch 56 allows the lower section 44 to pivot relative to the upper section 42 which is fixed to the end panel 28.

Referring to FIGS. 4–6, the front surface 46 of the lower section 44 comprises a seat 58 for receiving the collar 38. The seat 58 comprises a first surface 60 parallel to the rear surface 48 and a second surface 62 that forms an acute angle 64 with the rear surface 48, as shown in FIGS. 5 and 6. Around the periphery of the seat 58, the front surface 46 angles away from the seat 58, toward the rear surface 48. The angled front surface 46 aids the deflection of objects (not shown) away from the handrail 16 (FIG. 1).

The collar 38 comprises a cellular sponge rubber, or other pliable elastic material, formed into a shape having a front edge 66, an outside surface 68, a seat surface 70, and a channel 72 (see also FIG. 3). The front edge 66 is a flat surface perpendicular to the direction of travel of the handrail 16 through the collar 38. The flat surface of the front edge 66 tends to prevent objects from becoming entrapped. The seat surface 70 comprises a mating geometry with the seat 58 in the base 40. In the preferred embodiment, therefore, the seat surface 70 comprises a first 74 and second 76 surface. The first surface 74 is parallel to the rear surface 48 of the base 40 and the second surface 76 forms an acute angle 64 with the rear surface 48 as is shown in FIGS. 5 and 6, when the base 40 and the collar 38 are coupled. A person of skill in the art will recognize that different embodiments of the mating seat surfaces between the collar 38 and the base 40 may be chosen and still facilitate the movement of collar 38 material away from handrail 16 in the event an object (not shown) becomes lodged therebetween.

The cross-sectional area of the channel 72 increases as the channel 72 extends from the front edge 66 to the seat surface 70. FIGS. 5 and 6, illustrate in cross-section that the cross-sectional area of the channel 72 increases in both the X (FIG. 5) and Y (FIG. 6) planes, while traveling through the collar 38 in the Z direction.

The outside surface 68 of the collar 38 extends from the front edge 66 in the direction of the seat surface 70 at an angle away from the handrail 16 (FIG. 1) traveling through the channel 72. The angled outside surface 68 compliments the angled front surface 46 of the base 40, also facilitating the deflection of foreign objects (not shown) away from the moving handrail 16.

Referring to FIGS. 2 and 2A, in the operation of the handrail safety device 18, the device is mounted on the exterior surface 54 of the entry housing end panel 28. The handrail 16 passes through the collar 38 of the device 18, the base 40, the end panel 28, and into the balustrade entry housing 24.

Referring to FIG. 3, after the lower section 44 and collar 38 are symmetrically aligned relative to the handrail 16, the upper section 42 of the base 40 is fixed to the entry housing 24. The slots 50 in the upper section 42 allow for positional adjustment. Referring to FIGS. 2 and 2A, the lower section 44 of the base 40 and the attached collar 38 are held a distance away from the end panel 28 of the entry housing 24 by the plunger 36 of the electrical switch 30 mounted within the housing 24. In this position, the plunger 36 is extended and the switch 30 may be activated by moving the plunger 36 within the switch 30. A person of skill in the art will recognize that a number of different type switches may be used, wired in a number of different ways to accomplish the desired signal to the controller (not shown) of the escalator.

In the event of a foreign object (not shown) strikes the device 18, the lower section 44 and collar 38 pivot about the notch 56 (FIG. 27 in the direction of the end panel 28. The travel of the lower section 44 forces the plunger 36 of the electrical switch 30 into the switch 30, thereby sending a signal to the controller (not shown). The controller, in turn, slows and stops the escalator 10 (FIG. 1) to avoid any damage to the foreign object (not shown) and/or the balustrade 10. The angled exterior surfaces 68,46 of the collar 38 and the base 40 facilitate deflection of the object away from the moving handrail 16 (FIG. 2).

Referring to FIG. 2, if in the period of time between when the controller (not shown) is signaled and the handrail 16 finally stops travelling, the foreign object becomes (not shown) entrapped and drawn in between the handrail 16 and the collar 38, several features of the present invention will facilitate extraction of the foreign object and minimize damage to the object and the balustrade.

Referring to FIGS. 5 and 6, first, the increasing cross-sectional area of the collar channel 72 minimizes the entrapment forces on the object. The cross-sectional geometry of the channel 72 at the front edge 66 is such that a minimal air gap is left between the collar 38 and the moving handrail 16. The small air gap helps prevent objects from being drawn in between the collar 38 and the handrail 16. As the channel 72 extends toward the seat surface 70, however, the cross-sectional area increases and more space is left around the handrail 16. Hence, in the event an object is drawn in between the handrail 16 and the collar 38, less collar 38 material must be deflected and therefore less force is imparted to the object.

Second, the collar 38 comprises a cellular sponge rubber having a hardness on the Shore scale of between 30A and 35A. Sponge rubber having a hardness in this range is easily deformable. Hence, the readily deformable collar 38 minimizes the entrapment forces imparted to the object.

Third, the collar seat 70 geometry angled relative to the travel of the handrail 16, facilitates the deflection of the collar 38 material away from the moving handrail 16. Specifically, lateral entrapment forces tend to deflect the collar 38 material up the seat 70 rather than simply compressing it. The entrapment forces on the object are therefore minimized.

Although the invention has been shown and described with respect to a best mode embodiment thereof, it should be understood by those of ordinary skill in the art that the foregoing and various other changes, omissions and additions in the form and detail thereof may be make herein without departing from the spirit and scope hereof.

We claim:

1. A handrail entry safety device for a balustrade having an enclosure and a handrail, comprising:

a collar; and a base, having an upper section with means for attaching said base to the enclosure of the balustrade, and a lower section, having a seat for receiving said collar;

wherein said lower section and said collar receive and substantially surround the handrail; and wherein said upper section is hingedly attached to said lower section above the handrail, thereby enabling said lower section and said collar to pivot together.

2. A handrail entry safety device according to claim 1, wherein said collar comprises:

a first surface;

a seat surface; and a channel, having a cross-sectional area, extending through said surfaces, wherein said cross-sectional area of said channel increases as said channel extends from said first surface to said seat surface;

wherein said collar seats in, and is attached to, said lower section along said seat surface.

3. A handrail entry safety device according to claim 2, wherein said seat surface of said collar and said seat of said lower section comprise mating surfaces.

4. A handrail entry safety device according to claim 2, wherein said collar further comprises an exterior surface, extending from said first surface to said seat surface, at an angle away from the handrail received within said channel;

wherein said angled exterior surface tends to deflect foreign objects away from the handrail.

5. A handrail entry safety device according to claim 2, wherein said collar comprises cellular sponge rubber having a hardness on the Shore scale of between 30A and 35A.

6. A handrail entry safety device according to claim 2, wherein said base comprises thermo-plastic polyurethane having a hardness on the Shore scale of between 90A and 95A.

7. A handrail entry safety device according to claim 2, wherein said first surface is perpendicular to the direction of travel of the handrail.

8. A handrail entry safety device according to claim 1, further comprising a switch means;

wherein an object striking and pivoting one or both of said lower section and said collar toward the enclosure, actuates said switch means.

9. A handrail entry safety device according to claim 3, wherein said base has a front and a rear surface, and said seat is formed in said front surface; and wherein said mating surface of said seat forms an acute with said rear surface of said base, said acute angle defined by an initial line in the plane of said rear surface and an terminal line in the plane of the seat, said angle being swept through said base;

wherein lateral forces applied within said channel tend to push said collar material up said seat, away from said channel.

10. A handrail entry safety device according to claim 3, wherein said collar further comprises an exterior surface, extending from said first surface to said seat surface, at an angle away from the handrail received within said channel;

wherein said angled exterior surface tends to deflect foreign objects away from the handrail.

11. A handrail entry safety device according to claim 10, wherein said first surface is perpendicular to the direction of travel of the handrail.

12. A handrail entry safety device according to claim 11, further comprising a switch means;

wherein an object striking and pivoting one or both of said lower section and said collar toward the enclosure, actuates said switch means.

* * * * *